US009574141B2

(12) United States Patent
Zeng et al.

(10) Patent No.: US 9,574,141 B2
(45) Date of Patent: Feb. 21, 2017

(54) WET START-UP METHOD FOR HYDROGENATION UNIT, ENERGY-SAVING HYDROGENATION PROCESS AND HYDROGENATION APPARATUS

(71) Applicants: CHINA PETROLEUM & CHEMICAL CORPORATION, Beijing (CN); Fushun Research Institute of Petroleum and Petrochemicals, SINOPEC, Fushun, Liaoning (CN)

(72) Inventors: Ronghui Zeng, Liaoning (CN); Tao Liu, Liaoning (CN); Xiangchen Fang, Liaoning (CN); Zhaoming Han, Liaoning (CN); Xuehui Zhang, Liaoning (CN); Shike Sun, Liaoning (CN); Chong Peng, Liaoning (CN); Rong Guo, Liaoning (CN); Jihua Liu, Liaoning (CN); Benzhe Li, Liaoning (CN)

(73) Assignees: CHINA PETROLEUM & CHEMICAL CORPORATION, Beijing (CN); Fushun Research Institute of Petroleum and Petrochemicals, SINOPEC, Fushun (CN)

( * ) Notice: Subject to any disclaimer, the term of this patent is extended or adjusted under 35 U.S.C. 154(b) by 510 days.

(21) Appl. No.: 14/068,506

(22) Filed: Oct. 31, 2013

(65) Prior Publication Data

US 2014/0124408 A1 May 8, 2014

(30) Foreign Application Priority Data

Nov. 3, 2012 (CN) ..... 2012 1 0432650
Nov. 3, 2012 (CN) ..... 2012 1 0432678

(51) Int. Cl.
*C10G 49/24* (2006.01)

(52) U.S. Cl.
CPC ..... *C10G 49/24* (2013.01); *C10G 2300/1088* (2013.01); *C10G 2300/4031* (2013.01)

(58) Field of Classification Search
CPC ..... C10G 49/24; C10G 2300/1088; C10G 2300/4031
See application file for complete search history.

(56) References Cited

U.S. PATENT DOCUMENTS

| | | | | | |
|---|---|---|---|---|---|
| 3,873,440 | A * | 3/1975 | Hallman | C10G 49/24 208/108 |
| 4,446,007 | A | 5/1984 | Smith | |
| 4,485,006 | A * | 11/1984 | Biceroglu | C10G 49/24 208/216 R |
| 5,688,736 | A * | 11/1997 | Seamans | B01J 27/049 208/112 |
| 7,713,905 | B2 | 5/2010 | Dufresne et al. | |

FOREIGN PATENT DOCUMENTS

| | | | |
|---|---|---|---|
| CN | 1952058 | A | 4/2007 |
| CN | 101492607 | A | 7/2009 |
| CN | 101492613 | A | 7/2009 |
| CN | 102041044 | A | 5/2011 |
| CN | 102041049 | A | 5/2011 |
| CN | 102041050 | A | 5/2011 |
| CN | 102041051 | A | 5/2011 |
| CN | 102049318 | A | 5/2011 |
| CN | 102051204 | A | 5/2011 |
| CN | 102443412 | A | 5/2012 |
| CN | 102443425 | A | 5/2012 |
| CN | 102690685 | A | 9/2012 |

OTHER PUBLICATIONS

Zuenzhong Chen. "Application of wet pre-sulfiding technology for hydrocracking catalysts" Petroleum Refinery Engineering. vol. 42, No. 1, 2012, pp. 52-55.
Bin Zhou, et al. "Summary of Start-up and operation of 70Mt/a jet fuel hydrogenation unit" Chemical Engineering & Equipment. No. 3, Mar. 2012, pp. 67-70.
Bin Zhou, et al. "Application of wet pre-sulfiding technology for hydrocracking catalysts" Chemical Engineering & Equipment, No. 3, Mar. 2012, pp. 67-70.

* cited by examiner

*Primary Examiner* — Randy Boyer
*Assistant Examiner* — Juan Valencia
(74) *Attorney, Agent, or Firm* — Novick, Kim & Lee, PLLC; Allen Xue

(57) ABSTRACT

The present invention relates to a wet start-up method for hydrogenation unit, an energy-saving hydrogenation process, and a hydrogenation apparatus. The method involves heating a start-up activating oil to a specific temperature and flowing the heated oil through a bed of hydrogenation catalyst bed, so that the temperature at the catalyst bed layer is increased to 180±10° C. or above by means of heat exchange and the reaction heat generated from activation in the start-up method.

30 Claims, No Drawings

WET START-UP METHOD FOR HYDROGENATION UNIT, ENERGY-SAVING HYDROGENATION PROCESS AND HYDROGENATION APPARATUS

CROSS REFERENCE TO RELATED APPLICATIONS

This application claims priority to Chinese Application No. 201210432650.4, filed on Nov. 3, 2012, entitled "Wet Start-up Method for Hydrogenation Unit" and Chinese Application No. 201210432678.8, filed on Nov. 3, 2012, entitled "A Start-up Method for Hydrogenation Unit", which are specifically and entirely incorporated by reference.

FIELD OF THE INVENTION

The present invention belongs to a process in the technical field of refining, in particular relates to a wet start-up method for hydrogenation unit that utilizes a sulfurized type catalyst, an energy-saving hydrogenation process, and a hydrogenation apparatus.

BACKGROUND OF THE INVENTION

As environmental protection laws and regulations become stringent increasingly, the demand for clean light fuels is more and more. Hydrogenation technology is an effective means for production of clean products; therefore, hydrogenation units have become standard equipment in oil refineries, and more and more hydrogenation units are used in oil refining enterprises.

The technical core of hydrogenation units lies in the application of hydrogenation catalysts. The hydrogenation function of hydrogenation catalysts comes from active metals, which are usually classified into noble metals and non-noble metals. Non-noble metals are usually used, mainly including VIB and VIII groups of metal elements (e.g., Mo, W, Ni, and Co, etc.). These metals usually exist in oxidation state in commercial hydrogenation catalysts. Metals and metal atoms in oxidation state have low hydrogenation performance, and they will exhibit high hydrogenation performance only after they are converted into sulfurized state. Therefore, to attain best hydrogenation performance of a hydrogenation catalyst, the catalyst must be sulfurized before used. Hydrogenation catalysts can be classified into sulfurized type catalysts (a sulfurizing agent is introduced into the catalyst, but the active metals are not converted into sulfurized state completely) and sulfurized-state catalysts (the active metals are converted into sulfurized state completely).

The hydrogenation process usually has to be carried out at a high temperature. During start-up process of a hydrogenation unit, the unit must be heated up from normal temperature to a higher temperature (usually ≥300° C.). Hydrogenation units are usually equipped with a heating furnace to provide heat during the start-up process and normal production process of the units. Hydrogenation reactions are usually strong exothermic reactions. In the normal production process of a hydrogenation unit, the outlet temperature of the reactor is much higher than the inlet temperature of the reactor. Thus, the materials can be heated by heat exchange without any heating furnace. However, during start-up process, since the normal hydrogenation reaction hasn't started yet, there is no heat source for heating up the unit; moreover, a heating furnace is required during start-up process since the required temperature can't be reached if any device other than a heating furnace is used. The heating furnace is a high temperature and high pressure device in the hydrogenation unit and it accounts for a large part of the equipment investment. Moreover, the heating furnace is only used during start-up process, and has a very low utilization ratio.

Patent document CN200910188142.4 discloses a sulfurizing agent supply method for wet sulfurization process of catalyst, which is mainly used for start-up process of liquid circulating hydrogenation units. With that method, a heating furnace is required. Patent document CN 200510047487.X discloses a start-up method for FCC gasoline hydro-desulfurization and olefin reduction. That method mainly utilizes reformate as sulfurized oil and can avoid the temperature rise in the sulfurization process, it is only applicable to gasoline hydrogenation units that contain zeolite catalysts.

Patent document U.S. Pat. No. 5,688,736 discloses a catalyst sulfurization method, but that method strictly forbids the use of olefin-containing start-up oil during start-up process. Patent documents CN200910188114.2, CN200910204266.7, CN200810010242.3, CN200810010245.7, CN200910204248.9, and CN200910204249.3 disclose start-up methods for hydrogenation units that utilize a sulfurized type catalyst, but those methods require an activating oil with low olefin content during start-up process, and the heat required for heating up the reaction system in the catalyst activation process has to be provided by a heating furnace. Patent document CN200910204283.0 "Start-up Method for Residual Oil Hydrotreating Process" discloses a start-up method for hydrogenation units that contain a partially sulfurized type hydrogenation guard catalyst, but the heat has to be provided by a heating furnace during start-up process.

For start-up process of hydrogenation unit that utilize a sulfurized type hydrogenation catalyst, the method that is used mostly is to introduce a start-up activating oil at low temperature and heat up the unit at a specific heating rate, till the temperature is close to the reaction starting temperature of the feedstock; then, the activating oil can be replaced by the feedstock by steps. However, a heating furnace is required during start-up process to provide the heat required for heating up the reaction system, and the energy consumption during start-up process is heavy. For units that are not equipped with a heating furnace, the start-up process can not be accomplished with that method. In addition, the system pressure drop will be increased severely and the energy consumption will be increased severely if a heating furnace is used, owing to the complex internal structure of the heating furnace.

SUMMARY OF THE INVENTION

To overcome the shortcomings in the prior art, the present invention provides a wet start-up method for hydrogenation unit that utilizes a sulfurized type hydrogenation catalyst, an energy-saving hydrogenation process, and a hydrogenation apparatus, to achieve a smooth and steady start-up process and normal operation of the apparatus without heating furnace.

The wet start-up method for hydrogenation unit provided in the present invention comprises the following steps:

(a) Utilizing a low-temperature heat source to heat up a start-up activating oil, leading the heated start-up activating oil and circulating hydrogen into a hydrogenation unit that contains a sulfurized type hydrogenation catalyst, to activate the sulfurized type hydrogenation catalyst;

(b) Stopping the use of the low-temperature heat source, utilizing the reaction heat generated from the activating reaction of the sulfurized type hydrogenation catalyst to heat up the materials in the hydrogenation unit to 180±10° C., and then introducing an olefin-rich gas and/or olefin-rich light distillate oil into the hydrogenation unit, to carry out olefin hydrogenation reaction;

(c) Utilizing the reaction heat generated from the olefin hydrogenation reaction to further heat up the materials in the hydrogenation unit to 230±10° C., and keeping at constant temperature for at least 4 h;

(d) Heating up further to a temperature higher than 240° C., reducing the introduction amount of the olefin-rich gas and/or olefin-rich light distillate oil gradually, replacing the start-up activating oil with feedstock gradually, and utilizing the reaction heat generated from the feedstock hydrogenation reaction to heat up the materials in the hydrogenation unit further, till the target temperature is reached.

The present invention further provides an energy-saving hydrogenation process, comprising: utilizing the method described above to accomplish wet start-up process, and replacing the start-up activating oil with feedstock to carry out hydrogenation reaction when the target temperature is reached.

The present invention further provides a hydrogenation apparatus, comprising a feeding system, a hydrogenation reactor, a circulating hydrogen system, a heat exchange system for heat exchange between the reactor effluents and the raw materials, and a hydrogenated product separation system, wherein, in the heat exchange system for heat exchange between the reactor effluents and the raw materials, the outlet pipeline of the raw materials after heat exchange directly communicates with the inlet of the hydrogenation reactor.

The method provided in the present invention is especially suitable for hydrogenation processes that have overall reaction temperature rise greater than 20° C., preferably greater than 30° C., such as hydroupgrading or hydrofining of diesel, hydrofining of coked naphtha, hydrotreating and hydrocracking of vacumn gas oil, and hydrotreating of residual oil, etc. A heating furnace used in hydrogenation reaction refers to a heating device designed to heat up the materials to the temperature required at the inlet of the hydrogenation reactor in the normal operation process of a hydrogenation unit.

A heating furnace is required to heat up the bed temperature of the catalyst bed during wet start-up process of hydrogenation units in the prior art. The present invention utilizes the combination of a low-temperature heat source, the heat generated from the sulfurized type catalyst activation process, the reaction heat generated from the reaction of introduced olefin-rich gas and/or olefin-rich light distillate oil at relative low temperature, and the reaction heat generated from the hydrogenation reaction of feedstock at relative high temperature to accomplish start-up process for the unit; therefore, no heating furnace is required. After start-up process, the normal reaction process can be maintained with the reaction heat, since the hydrogenation reaction belongs to a strong exothermic reaction. In that way, the equipment investment and operation cost can be reduced greatly.

DETAILED DESCRIPTION OF THE EMBODIMENTS

The wet start-up method for hydrogenation unit provided in the present invention comprises the following steps:

(a) Utilizing a low-temperature heat source to heat up a start-up activating oil, leading the heated start-up activating oil and circulating hydrogen into a hydrogenation unit that contains a sulfurized type hydrogenation catalyst, to activate the sulfurized type hydrogenation catalyst;

(b) Stopping the use of the low-temperature heat source, utilizing the reaction heat generated from the activating reaction of the sulfurized type hydrogenation catalyst to heat up the materials in the hydrogenation unit to 180±10° C., and then introducing an olefin-rich gas and/or olefin-rich light distillate oil into the hydrogenation unit, to carry out olefin hydrogenation reaction;

(c) Utilizing the reaction heat generated from the olefin hydrogenation reaction to further heat up the materials in the hydrogenation unit to 230±10° C., and keeping at constant temperature for at least 4 h;

(d) Heating up further to a temperature higher than 240° C., preferably equal to or higher than 250° C., reducing the introduction amount of the olefin-rich gas and/or olefin-rich light distillate oil gradually, replacing the start-up activating oil with feedstock gradually, and utilizing the reaction heat generated from the feedstock hydrogenation reaction to heat up the material in the hydrogenation unit further, till the target temperature is reached.

According to the present invention, in step (a), preferably the low-temperature heat source is utilized to heat up the start-up activating oil to the reaction starting temperature of activating reaction of the sulfurized type hydrogenation catalyst, i.e., the temperature at which the exothermic activating reaction of the sulfurized type hydrogenation catalyst starts; in other words, the low-temperature heat source can be stopped once the activating reaction starts, and the heat generated from the activating reaction of the catalyst can be utilized to heat up the materials further; in that way, the reaction heat can be utilized as far as possible, thereby the energy consumption can be reduced as far as possible. Specifically, preferably the materials is heated up to 80~470° C., more preferably 130~170° C.

In the present invention, unless otherwise specified, the material temperature or reaction temperature in the reactor refers to average temperature.

In step (a) of the wet start-up method for hydrogenation unit provided in the present invention, the sulfurized type hydrogenation catalyst can be any sulfurized type catalyst; preferably, the sulfurized type hydrogenation catalyst can be a sulfurized type catalyst that contains elemental sulfur that serves as a sulfurizing agent; the sulfurized type catalyst can be prepared with any conventional technique in the art, or can be a commercial sulfurized type catalyst.

In step (a) of the wet start-up method for hydrogenation unit provided in the present invention, optimally the sulfurized type hydrogenation catalyst doesn't contain any zeolite. If a catalyst that contains zeolite is used, preferably the mass content of zeolite in the sulfurized type hydrogenation catalyst is lower than 5%, more preferably lower than 3%, optimally lower than 2%.

In another preferred embodiment, the sulfurized type hydrogenation catalyst can comprise a hydrocracking catalyst that contains zeolite and/or a hydroupgrading catalyst that contains zeolite; based on the total mass of the sulfurized type hydrogenation catalyst, the mass content of zeolite can be 5%~60%, preferably 10%~40%, in that case, ammonia should be introduced starting from the process that the materials are heated up from 230±10° C. to 260±10° C. in step (d); in addition, preferably the introduction of ammonia should be stopped when the temperature reaches to or is higher than 280° C., more preferably the introduction of ammonia should be stopped when the temperature is within 280~300° C. range.

The purpose of introducing ammonia is to neutralize the acid sites of zeolite and decrease the activity of the catalyst, so that the temperature rise can be controlled more easily. Those skilled in the art can choose appropriate introduced amount of ammonia as required. Preferably, ammonia is introduced in an amount that ensures the total mass concentration of ammonia and ammonium ions in high-pressure separator water is 0.4%~2.0%, preferably 0.6%~1.8%. The high-pressure separator water is a concept well known in the art. It refers to softened water fed before the high-pressure air cooler or the water generating in the reaction process, dynamically stored in the high-pressure separator, which absorbs ammonia; the high-pressure separator water also contains some other substances, such as hydrogen sulfide and light oil, etc. The high-pressure separator water can be discharged continuously or as required.

In step (a) of the wet start-up method for hydrogenation unit provided in the present invention, the circulating hydrogen refers to the hydrogen-rich high pressure gas during start-up process, wherein, based on the volume of circulating hydrogen, the hydrogen purity of the gas is not lower than 50 vol %, preferably is not lower than 60 vol %, optimally is not lower than 70 vol %.

In step (a) of the wet start-up method for hydrogenation unit provided in the present invention, the start-up activating oil used during start-up process of the hydrogenation unit is a petroleum distillate which is rich of saturated hydrocarbons, such as straight-run jet fuel or straight-run diesel, etc.; or it can be jet fuel or diesel obtained by deep hydrofining, or jet fuel or diesel obtained by hydrocracking. Based on the weight of the start-up activating oil, usually the nitrogen content in the start-up activating oil is not higher than 200 μg/g, preferably is not higher than 100 μg/g. The inlet temperature of the hydrogenation unit at which the start-up activating oil is introduced is preferably 50° C.~150° C., more preferably 60~120° C., optimally 70~90° C. The start-up process is carried out in existence of hydrogen gas, and the volume ratio of hydrogen/oil usually is 100:1~2000:1, preferably 200~2000:1, more preferably 500~1200:1; the liquid hourly space velocity usually is 0.1~10.0 $h^{-1}$, preferably 0.2~8.0 $h^{-1}$, more preferably 0.5~2.0 $h^{-1}$. The start-up activating oil can be used in circulation, preferably recycled by hot oil circulation, i.e., the start-up activating oil discharged from the reactor is treated by gas-liquid separation without cooling, and the liquid phase is recycled directly, while the gas phase is cooled and then recycled by a circulating compressor.

In step (a) of the wet start-up method for hydrogenation unit provided in the present invention, there is no special restriction on the specific temperature of the low-temperature heat source, as long as the low-temperature heat source can heat up the start-up activating oil and attain the above-mentioned purpose. A low-temperature heat source usually refers to a heat source at 100~240° C., preferably at 120~200° C. The low-temperature heat source is provided from a low-temperature heat source supplier, which can be at least one selected from the group consisting of steam generator, steam heating system, electric heater, and fractionating tower heating furnace. The low-temperature heat source supplier preferably communicates with the hydrogenation unit via a heat exchanger.

In step (b) of the wet start-up method for hydrogenation unit provided in the present invention, the olefin-rich gas usually refers to gaseous hydrocarbons with 5%~80% mass content of mono-olefins, such as olefin-rich gas obtained from a catalytic cracking unit, an ethylene unit, or an unit for producing olefins from methanol, or coke oven gas, which contains $C_2$~$C_4$ olefins. The olefin-rich light distillate oil refers to liquid hydrocarbons with 10%~60% mass content of mono-olefins, and preferably is at least one selected from the group consisting of coked gasoline, light oil byproducts obtained during ethylene production by steam cracking, and light coal tar. The olefin-rich gas or olefin-rich light distillate oil should be purified to meet the requirement for impurity content before it can be fed into the hydrogenation unit. At that temperature, the olefins undergo hydrogenation reaction, which releases heat and increase the temperature in the hydrogenation unit. The olefin-rich gas and/or olefin-rich light distillate oil can be introduced at an appropriate ratio, depending on the expected rate of temperature rise.

In step (d) of the wet start-up method for hydrogenation unit provided in the present invention, preferably the introduced amount of olefin-rich gas and/or olefin-rich light distillate oil is decreased gradually together with the replacement of the start-up activating oil by feedstock gradually, so that the difference between the inlet temperature (i.e., inlet temperature of the first catalyst bed layer) and the outlet temperature (i.e., outlet temperature of the last catalyst bed layer) of the hydrogenation unit is maintained at 5~40° C., preferably 8~25° C. When the temperature is equal to or higher than 280° C., preferably within 280-300° C., the introduction of olefin-rich gas and/or olefin-rich light distillate oil can be stopped.

Usually, for olefin-rich gas, the introduction amount is equal to or more than 20% of the volume of make-up hydrogen (i.e., supplementary hydrogen during start-up process), preferably 25%-~90%. For olefin-rich light distillate oil, the introduction amount is equal to or less than 80% of the volume of the total feedstock, preferably 10%~50%.

In step (c) of the wet start-up method for hydrogenation unit provided in the present invention, keeping at constant temperature refers to keeping at the range of 230±10° C. The purpose of keeping at constant temperature is to fully activate the catalyst. The duration of constant temperature is preferably 6~12 h.

In step (d) of the wet start-up method for hydrogenation unit provided in the present invention, preferably the proportion of feedstock is increased in 2~6 steps in the materials fed to the hydrogenation unit, and finally the start-up activating oil is fully replaced by feedstock. That procedure is well known by those skilled in the art, and the activation process has been completed essentially when that procedure is executed. For example, the start-up activating oil in the materials can be replaced by feedstock by steps at proportion of 25% feedstock (25 mass % of the feed oil is feedstock, and 75 mass % is start-up activating oil, the same below), 50% feedstock, 75% feedstock, and 100% feedstock, at a time interval equal to or longer than 2 h. Then, the reaction temperature is adjusted to meet the production requirement, and finally the feed oil is fully replaced by feedstock.

For a hydrogenation process that doesn't uses a heating furnace, the feedstock is usually liquid feedstock that has high content of impurities such as sulfur and nitrogen, high content of olefins, or high content of aromatics, such as one or more of straight-run vacumn gas oil, catalytic cracked diesel, catalytic cracked recycle oil, coal tar, coked gasoline, coked diesel, coked gas oil, ethylene cracking tar, ethylene cracking light oil, high-sulfur straight-run diesel, naphthenic straight-run diesel, and solvent deasphalted oil.

In the wet start-up method for hydrogenation unit provided in the present invention, the pressure in the activation process can be equal to or lower than the operating pressure; preferably, the pressure in the activation process is 50%~100% of the designed operating pressure, preferably 75%~100% of the designed operating pressure.

One of the most distinguishing characteristics of the wet start-up method for hydrogenation unit provided in the present invention is: start-up heating furnace is canceled.

The present invention further provides an energy-saving hydrogenation process, comprising: utilizing the method described above to accomplish wet start-up process, and replacing the start-up activating oil with feedstock to carry out hydrogenation reaction when the target temperature is reached.

Preferably, the method further comprises: exchanging heat between the feedstock and the effluent that flows out of the outlet of the hydrogenation unit, so that the feedstock is heated up to the required inlet temperature of the hydrogenation unit. The feedstock is not heated up with a hydrogenation reaction heating furnace. Therefore, the hydrogenation process provided in the present invention doesn't require a start-up heating furnace for process start-up or a hydrogenation reaction heating furnace for hydrogenation reaction.

Usually, after the start-up activating oil is fully replaced with feedstock, the inlet temperature of the hydrogenation unit must be adjusted. For example, the inlet temperature of the hydrogenation unit can be adjusted by adjusting the amount of cold hydrogen and/or heat exchange temperature, to meet the requirement for inlet temperature of the hydrogenation unit in subsequent operations.

The hydrogenation process can comprise a feedstock hydrotreating process and a hydrocracking (hydroupgrading) process, etc. The processing conditions are ordinary hydro-processing conditions in the art.

The present invention further provides a hydrogenation apparatus, comprising a feeding system, a hydrogenation reactor, a circulating hydrogen system, a heat exchange system for heat exchange between the reactor effluents and the raw materials, and a hydrogenated product separation system, wherein, in the heat exchange system for heat exchange between the reactor effluents and the raw materials, the outlet pipeline of the raw materials after heat exchange directly communicates with the inlet of the hydrogenation reactor.

In the prior art, the heating furnaces are mainly used to provide heat for process start-up and production. In the present invention, since the temperature of feed material attained by heat exchange with the reactor effluents can meet the requirement, in combination with the start-up method described above, hydrogenation reaction heating furnace and start-up process heating furnace can be canceled.

According to the method described above, in the start-up process, preferably the apparatus further comprises a low-temperature heat source supplier and an olefin-rich gas supplier and/or an olefin-rich light distillate oil supplier, which communicate with the hydrogenation reactor respectively, and the low-temperature heat source supplier is designed to supply a low-temperature heat source to heat up the start-up activating oil.

In the present invention, the suppliers refer to apparatuses that can store materials and supply the materials to the hydrogenation reactor. The low-temperature heat source supplier can be any apparatus that supply low temperature heat to the start-up activating oil; for example, it can be at least one selected from the group consisting of steam generator, steam heating system, electric heater, and fractionating tower heating furnace. A fractionating tower heating furnace is an apparatus designed to heat up the raw materials in the fractionating tower. The olefin-rich gas supplier can be a gas tank that contains olefins-rich gas; the olefin-rich light distillate oil supplier can be an oil tank that contains olefins-rich oil.

There is no special restriction on the communication between the suppliers and the hydrogenation reactor in the present invention, which is to say, the suppliers can directly or indirectly communicate with the hydrogenation reactor. For example, the low-temperature heat source supplier can communicate with the hydrogenation reactor via a heat exchanger, so as to supply heat for the start-up activating oil.

There is no special restriction on the material supply methods in the present invention; for example, the olefin-rich gas can be supplied in mixture with hydrogen gas; the olefin-rich light distillate oil can be supplied in mixture with the start-up activating oil.

The method provided in the present invention involves control of the introduction amount of the start-up activating oil and the introduction amount of the olefin-rich gas and/or olefin-rich light distillate oil. Therefore, preferably, the start-up activating oil supplier communicates with the hydrogenation reactor through a pipeline with a control valve. Preferably, the olefin-rich gas supplier and/or olefin-rich light distillate oil supplier communicates with the hydrogenation reactor through a pipeline with a control valve.

According to the process described above, when a catalyst that contains zeolite is used, preferably ammonia is introduced to neutralize the reaction sites. Therefore, the apparatus can further comprise an ammonia supplier that communicates with the hydrogenation reactor; in addition, the ammonia supplier preferably communicates with the hydrogenation reactor through a pipeline with a control valve.

To achieve the objective described above, those skilled in the art can choose appropriate communication method and supply method.

In addition, preferably temperature measurement elements are equipped at the inlet and outlet of the hydrogenation reactor respectively, to measure the inlet temperature and outlet temperature of the hydrogenation reactor.

In the present invention, the hydrogenation reactor preferably contains a sulfurized type hydrogenation catalyst.

The present invention will be detailed in the following examples.

The hydrogenation apparatus used in examples 1-1~1-3 of the present invention comprises a feeding system, a low-temperature heat source supplier, a heat exchanger, a fixed bed hydrogenation reactor, a circulating hydrogen system, a hydrogenated effluents separation system, a start-up activating oil supplier, and an olefin-rich gas supplier. Wherein, the low-temperature heat source supplier communicates with the hydrogenation reactor via the heat exchanger, the start-up activating oil supplier communicates with the hydrogenation reactor through a pipeline with a control valve, the olefin-rich gas supplier communicates with the hydrogenation reactor through a pipeline with a control valve, and two temperature measurement elements are equipped at the inlet and outlet of the fixed bed hydrogenation reactor respectively.

The hydrogenation apparatus used in examples 2-1~2-3 of the present invention comprises a feeding system, a low-temperature heat source supplier, a heat exchanger, a fixed bed hydrogenation reactor, a circulating hydrogen system, a hydrogenated effluents separation system, a start-up activating oil supplier, an ammonia supplier, and an olefin-rich light distillate oil supplier. Wherein, the low-temperature heat source supplier communicates with the hydrogenation apparatus via the heat exchanger, the start-up activating oil supplier communicates with the hydrogenation reactor through a pipeline with a control valve, the olefin-rich light distillate oil supplier communicates with the hydrogenation reactor through a pipeline with a control valve, the ammonia supplier communicates with the hydrogenation reactor through a pipeline with a control valve, and two temperature measurement elements are equipped at the inlet and outlet of the fixed bed hydrogenation reactor respectively.

Example 1-1

A specific process of the method provided in the present invention is as follows: straight-run diesel is used as the start-up activating oil; first, the start-up activating oil is heated up by means of the heat exchanger; then, the heated start-up activating oil and circulating hydrogen (with 90 vol % hydrogen content) flow through a reaction area that contains sulfurized type hydrogenation catalyst; the heat exchanger is stopped when the start-up activating oil is heated up to 140° C. and the start-up activating oil is further heated up by the heat generated in the activating reaction of the hydrogenation catalyst; a purified catalytic cracking gas (mixture of dry catalyzing gas and liquefied gas, with 30% or higher volume content of olefins) is introduced in an amount equal to 60 vol % of make-up hydrogen when the temperature reaches to 180° C.; then, the materials are heated up by the reaction heat of olefin hydrogenation reaction, and are activated for 8 h at 230° C. constant temperature. As the materials are further heated up, as the materials are heated up further, the start-up activating oil is replaced with feedstock by steps (at proportion of 25 vol %, 50 vol %, 75 vol %, and 100 vol %, at 2 h time interval); the introduction of the purified catalyzing is stopped when the materials are heated up to 280° C.; then, the inlet temperature is adjusted to the reaction temperature by the reaction heat obtained from the hydrogenation reaction of the feedstock, and the operational conditions are adjusted and the system is switched to normal production state.

Wherein, the sulfurized type hydrogenation catalyst is the hydrotreating catalyst FF-46 developed by SINOPEC Fushun Research Institute of Petroleum and Petrochemicals, which utilizes elemental sulfur as the sulfurized agent and doesn't contain zeolite.

The major components of the olefin-rich gas are shown in Table 1. The main properties of the start-up activating oil and feedstock are shown in Table 2. The process conditions and results of hydrogenation start-up process and hydrogenation reaction are shown in Table 3.

Examples 1-2 and 1-3

Carrying out hydrogenation start-up and hydrogenation reaction with the feedstock, method and apparatus described in example 1-1, with the difference shown in Table 3.

Comparative Example 1

Carrying out hydrogenation start-up and hydrogenation reaction with the raw materials, method and apparatus described in example 1-1, with the following difference: in this process, a heating furnace is used to provide direct heat during hydrogenation start-up, and the catalytic cracking gas introduction procedure is canceled. After the materials are heated up to 280° C., the start-up activating oil is replaced with feedstock by steps in the same way as described in example 1-1. The process conditions and results of hydrogenation start-up process and hydrogenation reaction are shown in Table 3.

TABLE 1

Major Components of the Olefin-Rich Gas

| Component of raw gas (vol %) | Purified catalytic cracking gas |
|---|---|
| $H_2$ | 2.4 |
| $CH_4$ | 12.4 |
| $C_2H_4$ | 6.5 |
| $C_3H_6$ | 24.6 |
| $H_2S$ | 2.0 |
| $CO + CO_2$ | <20 μg/g |

TABLE 2

Main Properties of the Start-up Activating Oil and Feedstock

| Property | Straight run diesel (start-up activating oil) | Mixed VGO (feedstock) | Mixed diesel (feedstock) |
|---|---|---|---|
| Density (20° C.)/g · $cm^{-3}$ | 0.846 | 0.926 | 0.858 |
| Distillation range/° C. | 170~350 | 340~590 | 176~362 |
| Sulfur content, wt % | 1.0 | 2.36 | 1.87 |
| Nitrogen content/μg · $g^{-1}$ | 80 | 1843 | 350 |
| Cetane number | 53 | — | 48 |
| Aromatics content, wt % | 20.1 | 58.4 | — |

TABLE 3

Process Conditions and Results

| | Example 1-1 | Comparative example 1 | Example 1-2 | Example 1-3 |
|---|---|---|---|---|
| Process Condition | | | | |
| Catalyst | FF-46 | FF-46 | FF-46 | FF-46 |
| Start-up method | Wet method | Wet method | Wet method | Wet method |
| Having Start-up heating furnace or not | No | Yes | No | No |
| Pressure/MPa | 10.0 | 10.0 | 14.0 | 6.0 |
| Volume ratio of hydrogen/oil in start-up process | 600 | 600 | 1200 | 500 |
| Liquid hourly space velocity in start-up process/$h^{-1}$ | 0.8 | 0.8 | 0.9 | 1.2 |
| Inlet temperature of fixed bed hydrogenation reactor when start-up activating oil is introduced/° C. | 80 | 80 | 90 | 70 |

TABLE 3-continued

| Process Conditions and Results | | | | |
|---|---|---|---|---|
| | Example 1-1 | Comparative example 1 | Example 1-2 | Example 1-3 |
| Temperature of start-up activating oil when low-temperature heat source is stopped/° C. | 140 | — | 140 | 140 |
| Temperature at which purified catalyzing gas is introduced/° C. | 180 | — | 185 | 170 |
| Temperature at which constant temperature activation is carried out/° C. | 230 | 230 | 240 | 220 |
| Duration of constant temperature activation | 8 h | 8 h | 6 h | 10 h |
| Temperature at which replacement with feedstock starts/° C. | 280 | 280 | 300 | 290 |
| Temperature at which the introduction of purified catalyzing gas is stopped/° C. | 280 | — | 290 | 300 |
| Temperature at which the oil is replaced fully by feedstock/° C. | 320 | 320 | 340 | 310 |
| Difference between inlet temperature of the first catalyst bed layer and outlet temperature of the last catalyst bed layer/° C. | 15~20 | — | 10~20 | 15~25 |
| Catalyst activity assessment conditions and result | | | | |
| Feedstock | Mixed diesel | Mixed diesel | Mixed VGO | Mixed diesel |
| Reaction pressure/MPa | 10.0 | 10.0 | 14.0 | 6.0 |
| Catalyst | FF-46 | FF-46 | FF-46 | FF-46 |
| Liquid hourly space velocity/$h^{-1}$ | 1.0 | 1.0 | 1.5 | 1.5 |
| Volume ratio of hydrogen/oil | 500 | 500 | 800 | 400 |
| Mean reaction temperature/° C. | 350 | 350 | 370 | 330 |
| Product properties | | | | |
| Cetane number of diesel | 52 | 52 | 45 | 51 |
| Sulfur content of diesel/$\mu g \cdot g^{-1}$ | 9.0 | 9.0 | 350 | 45 |
| Sulfur content of wax/$\mu g \cdot g^{-1}$ | — | — | 800 | — |
| Nitrogen content of vacumn gas oil/$\mu g \cdot g^{-1}$ | — | — | 300 | — |

In the normal operation process, the overall reaction temperature rise values in the above-mentioned hydrofining procedure of diesel and hydroprocessing procedure of vacumn gas oil are equal to or higher than 30° C., and the temperature of the feed materials can be increased to the required temperature at the inlet of the reactor by heat exchange; therefore, no hydrogenation reaction heating furnace is required. It can be seen from examples 1-1~1-3 and comparative example 1, with the wet start-up method provided in the present invention, the activity of the hydrogenation catalyst can be improved effectively, and a smooth and steady start-up process can be achieved without heating furnace. In addition, since the heating furnace is canceled, the equipment cost and energy consumption can be reduced greatly.

Example 2-1

Another specific process of the method provided in the present invention is as follows: straight-run diesel is used as the start-up activating oil; first, the start-up activating oil is heated up by means of the heat exchanger; then, the heated start-up activating oil and circulating hydrogen (with 90 vol % hydrogen content) flow through a reaction area that contains a sulfurized type hydrogenation catalyst with zeolite; the heat exchanger is stopped when the start-up activating oil is heated up to 150° C. and the start-up activating oil is further heated up by the reaction heat of the sulfurized type catalyst; coked naphtha is introduced in an amount equal to 10 vol % of the total feed amount of oil when the temperature reaches to 180° C., then, the materials are heated up by the reaction heat obtained from olefin hydrogenation reaction in the coked naphtha, and are activated for 8 h at 230° C. constant temperature; next, anhydrous liquid ammonia is introduced when the temperature rises to 245° C., and the introduction amount of the liquid ammonia ensure the total mass concentration of ammonia and ammonium ions in high-pressure separator water is maintained at 1.1 wt %; then, as the materials are heated up further, the oil is replaced with feedstock by steps (at proportion of 50 vol % and 100 vol %, at 4 h interval); the introduction of liquid ammonia and coked gasoline is stopped when the temperature rises to 290° C., and the inlet temperature of the reactor is increased with the reaction heat obtained from the hydrogenation reaction of feedstock to designed reaction temperature; then, the operating conditions are adjusted and the system is switched into normal production state.

Wherein, the catalysts used are FC-50 and FC-32 which are hydrocracking catalysts developed by SINOPEC Fushun Research Institute of Petroleum and Petrochemicals. The FC-50 and FC-32 catalysts contain 20 wt % and 32 wt % Y-type zeolite respectively.

The main properties of the oils are shown in Table 4. The conditions and results of hydrogenation start-up process and hydrogenation reaction are shown in Table 5.

Examples 2-2 and 2-3

Carrying out hydrogenation start-up and hydrogenation reaction with the feedstock, method and apparatus described in example 2-1, with the difference shown in Table 5.

Comparative Example 2

Carrying out hydrogenation start-up and hydrogenation reaction with the feedstock, method and apparatus described in example 2-1, with the following difference: in this process, a heating furnace is used to provide direct heat during hydrogenation start-up, and the coked naphtha introduction procedure is canceled. After the materials are heated up to 270° C., the start-up activating oil is replaced with feedstock by steps in the same way as described in example 1-1. The process conditions and results of hydrogenation start-up and hydrogenation reaction are shown in Table 5.

TABLE 4

Main Properties of the Oils

| Property | Coked naphtha (olefin-rich light distillate oil) | Straight-run diesel (start-up activating oil) | Iranian VGO (feed-stock) | Mixed diesel (feedstock) |
|---|---|---|---|---|
| Density (20° C.)/ $g \cdot cm^{-3}$ | 0.741 | 0.846 | 0.914 | 0.901 |
| Distillation range/° C. | 47~193 | 170~350 | 350~545 | 175~370 |
| Sulfur content, wt % | 0.44 | 1.0 | 1.74 | 1.32 |
| Nitrogen content/ $\mu g \cdot g^{-1}$ | 111 | 80 | 1535 | 985 |
| Cetane number | — | 53 | — | 45 |
| Aromatics contant, wt % | 12.0 | 20.1 | 43.8 | 43.5 |
| Olefins content, wt % | 22.0 | — | — | — |

TABLE 5

Process Conditions and Results

| | Example 2-1 | Comparative example 2 | Example 2-2 | Example 2-3 |
|---|---|---|---|---|
| Process Condition | | | | |
| Catalyst | FF-46/FC-32 | FF-46/FC-32 | FF-46/FC-50 | FF-46/FC-32 |
| Start-up method | Wet method | Wet method | Wet method | Wet method |
| Having Start-up heating furnace or not | No | Yes | No | No |
| Pressure/MPa | 12.0 | 12.0 | 15.7 | 8.0 |
| Volume ratio of hydrogen/oil in start-up process | 1000 | 1000 | 1200 | 700 |
| Liquid hourly space velocity in start-up process/$h^{-1}$ | 1.5 | 1.5 | 0.8 | 0.9 |
| Temperature of start-up activating oil when low-temperature heat source is stopped/° C. | 150 | — | 150 | 150 |
| Inlet temperature of fixed bed hydrogenation reactor when start-up activating oil is introduced/° C. | 80 | 80 | 70 | 90 |
| Temperature at which coked naphtha is introduced/° C. | 180 | — | 175 | 185 |
| Temperature at which constant temperature activation is carried out/° C. | 230 | 230 | 240 | 220 |
| Duration of constant temperature activation/h | 8 | 8 | 6 | 10 |
| Temperature at which replacement with feedstock starts/° C. | 270 | 270 | 295 | 260 |
| Temperature at which the introduction of coked naphtha is stopped/° C. | 290 | — | 295 | 290 |
| Temperature at which the introduction of anhydrous liquid ammonia is stopped/° C. | 290 | 290 | 295 | 285 |
| Temperature at which the oil is replaced fully by feedstock/° C. | 315 | 315 | 350 | 320 |
| Difference between inlet temperature of the first catalyst bed layer and outlet temperature of the last catalyst bed layer/° C. | 15~20 | — | 15~20 | 10~15 |
| Catalyst activity assessment conditions and result | | | | |
| Feedstock | Mixed diesel | Mixed diesel | Iranian VGO | Mixed diesel |
| Reaction pressure/MPa | 12.0 | 12.0 | 15.7 | 8.0 |

TABLE 5-continued

| Process Conditions and Results | | | | |
|---|---|---|---|---|
| | Example 2-1 | Comparative example 2 | Example 2-2 | Example 2-3 |
| Operational conditions in pretreating section | | | | |
| Catalyst | FF-46 | FF-46 | FF-46 | FF-46 |
| Liquid hourly space velocity/ $h^{-1}$ | 2.0 | 2.0 | 1.0 | 1.5 |
| Volume ratio of hydrogen/oil | 700 | 700 | 1000 | 500 |
| Mean reaction temperature/° C. | 340 | 340 | 386 | 350 |
| Nitrogen content of generated oil/$\mu g \cdot g^{-1}$ | 3.0 | 3.0 | 6.2 | 2.0 |
| Operating conditions in hydrocracking (hydro-upgrading) section | | | | |
| Catalyst | FC-32 | FC-32 | FC-50 | FC-32 |
| Liquid hourly svoace velocity/ $h^{-1}$ | 1.5 | 1.5 | 1.2 | 2.0 |
| Volume ratio of hydrogen/oil | 1000 | 1000 | 1200 | 800 |
| Mean reaction temperature/° C. | 360 | 360 | 380 | 370 |
| Conversion rate, mass % | — | — | 70 | — |
| Product properties | | | | |
| Yield of naphtha, mass % | 4.5 | 4.6 | — | 10.2 |
| Cetane number of diesel | 51 | 51 | — | 48 |
| Sulfur content of diesel/$\mu g \cdot g^{-1}$ | 1 | 1 | — | 1 |

In the normal operation process, the overall reaction temperature rise values in the above-mentioned hydroupgrading procedure of diesel and hydro-cracking procedure of wax oil are equal to or higher than 40° C., and the temperature of the feed materials can be increased to the required temperature at the inlet of the reactor by heat exchange; therefore, no hydrogenation reaction heating furnace is required. It can be seen from examples 2-1~2-3 and comparative example 2, with the wet start-up method provided in the present invention, the activity of the hydrogenation catalyst can be improved effectively, and a smooth and steady start-up process can be achieved without heating furnace. In addition, since the heating furnace is canceled, the equipment cost and energy consumption can be reduced greatly.

The invention claimed is:

1. A wet start-up method for hydrogenation unit, comprising the following steps:

(a) utilizing a low-temperature heat source to heat up a start-up activating oil, feeding the heated start-up activating oil and a circulating hydrogen into a hydrogenation unit, wherein the hydrogenation unit contains a sulfurized type hydrogenation catalyst, and the sulfurized type hydrogenation catalyst is activated;

(b) stopping the use of the low-temperature heat source, utilizing the reaction heat generated from the activating reaction of the sulfurized type hydrogenation catalyst to heat up materials in the hydrogenation unit to 180±10° C., and then introducing an olefin-rich gas and/or olefin-rich light distillate oil into the hydrogenation unit to carry out olefin hydrogenation reaction;

(c) utilizing the reaction heat generated from the olefin hydrogenation reaction to further heat up the materials in the hydrogenation unit to 230±10° C., and keeping the temperature constant for at least 4 h;

(d) heating the materials in the hydrogenation unit further to a temperature higher than 240° C., reducing the amount of the olefin-rich gas and/or olefin-rich light distillate oil gradually, replacing the start-up activating oil with a feedstock gradually, and utilizing the reaction heat generated from the feedstock hydrogenation reaction to heat up the materials in the hydrogenation unit until the target temperature is reached.

2. The method according to claim 1, wherein, in step (a), the low-temperature heat source is utilized to heat up the start-up activating oil to the reaction starting temperature of activating the hydrogenation reaction of the sulfurized type hydrogenation catalyst.

3. The method according to claim 1, wherein, in step (a), the sulfurized type hydrogenation catalyst contains elemental sulfur that serves as a sulfurizing agent.

4. The method according to claim 1, wherein, in step (a), the mass content of zeolite in the sulfurized type hydrogenation catalyst is lower than 5%.

5. The method according to claim 1, wherein, in step (a), the sulfurized type hydrogenation catalyst comprises a hydrocracking catalyst that contains zeolite and/or a hydroupgrading catalyst that contains zeolite; based on the total mass of the sulfurized type hydrogenation catalyst, the mass content of zeolite is 5% to 60%; in step (d), ammonia is introduced when the materials are heated up from 230±10° C. to 260±10° C.

6. The method according to claim 5, wherein, in step (d), the amount of ammonia is introduced so that the total mass concentration of ammonia and ammonium ions in high-pressure separator water is 0.4% to 2.0%.

7. The method according to claim 1, wherein, in step (a), the circulating hydrogen is a hydrogen-rich high pressure gas; based on the volume of circulating hydrogen, the hydrogen purity of the gas is not lower than 50 vol %.

8. The method according to claim 1, wherein, in step (a), the start-up activating oil is petroleum distillate which is rich in saturated hydrocarbons; based on the weight of the start-up activating oil, the nitrogen content is not higher than 200 μg/g, the inlet temperature of the hydrogenation unit when the start-up activating oil is introduced is 50° C. to 150° C.

9. The method according to claim 8, wherein, the start-up activating oil is at least one selected from the group consisting of straight-run jet fuel, straight-run diesel, jet fuel obtained by deep hydrofining, or diesel obtained by deep hydrofining, jet fuel obtained by hydrocracking, and diesel obtained by hydrocracking.

10. The method according to claim 1, wherein, the start-up process is carried out in existence of hydrogen gas, the volume ratio of hydrogen/oil is 100:1 to 2000:1, and the liquid hourly space velocity is 0.1 to 10.0 $h^{-1}$.

11. The method according to claim 1, wherein, in step (a), the low-temperature heat source is a heat source at 100 to 240° C.

12. The method according to claim 1, wherein, in step (a), the low-temperature heat source is provided from a low-temperature heat source supplier, which can be at least one selected from the group consisting of steam generator, steam heating system, electric heater, and fractionating tower heating furnace, and the low-temperature heat source supplier communicates with the hydrogenation unit via a heat exchanger.

13. The method according to claim 1, wherein, in step (b), the olefin-rich gas refers to gaseous hydrocarbons with 5% to 80% mass content of mono-olefins; the olefin-rich light distillate oil refers to liquid hydrocarbons with 10% to 60% mass content of mono-olefins.

14. The method according to claim 1, wherein, in step (b), the introduction amount of olefin-rich gas and/or olefin-rich light distillate oil is determined according to the required rate of temperature rise.

15. The method according to claim 14, wherein, the introduction amount of olefin-rich gas is equal to or more than 20% of the volume of make-up hydrogen.

16. The method according to claim 14, wherein, the introduction amount of olefin-rich light distillate is equal to or less than 80% of the total volume of the feedstock.

17. The method according to claim 1, wherein, in step (d), the proportion of the feedstock in the materials fed to the hydrogenation unit is increased 2 to 6 times until the start-up activating oil is fully replaced by the feedstock.

18. The method according to claim 1, wherein, in step (d), the introduction of the olefin-rich gas and/or the olefin-rich light distillate oil is stopped when the temperature reaches or is above 280° C.

19. The method according to claim 1, wherein, the pressure in the activation process is not higher than the designed operating pressure.

20. An energy-saving hydrogenation process, comprising: utilizing the method set forth in claim 1 to accomplish a wet start-up process, and feeding the feedstock into the hydrogenation unit when the target temperature is reached.

21. The process according to claim 20, wherein, the method further comprises: exchanging heat between the feedstock with the effluent from the hydrogenation unit and the feedstock to the hydrogenation unit.

22. The method according to claim 1, wherein, in step (a), the low-temperature heat source is utilized to heat up the start-up activating oil to 80-170° C.

23. The method according to claim 1, wherein, in step (a), the mass content of zeolite in the sulfurized type hydrogenation catalyst is lower than 2%.

24. The method according to claim 1, wherein, in step (a), the sulfurized type hydrogenation catalyst comprises a hydrocracking catalyst that contains zeolite and/or a hydroupgrading catalyst that contains zeolite; based on the total mass of the sulfurized type hydrogenation catalyst, the mass content of zeolite is 5% to 60%, and ammonia is introduced starting from the process that when the materials are heated up from 230±10° C. to 260±10° C., and the introduction of ammonia is stopped when the temperature is at or above 280° C.

25. The method according to claim 5, wherein, in step (d), the amount of ammonia is introduced so that in an amount that ensures the total mass concentration of ammonia and ammonium ions in high-pressure separator water is 0.6% to 1.8%.

26. The method according to claim 1, wherein, in step (a), the circulating hydrogen is a hydrogen-rich high pressure gas; based on the volume of circulating hydrogen, the hydrogen purity of the gas is not lower than 70 vol %.

27. The method according to claim 1, wherein, in step (a), the low-temperature heat source is a heat source at 120 to 200° C.

28. The method according to claim 14, wherein, the introduction amount of olefin-rich gas is 25% to 90% of the volume of make-up hydrogen.

29. The method according to claim 14, wherein, the introduction amount of olefin-rich light distillate is 10% to 50% of the total volume of the feedstock.

30. The method according to claim 1, wherein, the pressure in the activation process is 75% to 100% of the designed operating pressure.

* * * * *